United States Patent [19]

Busch

[11] 4,178,119

[45] Dec. 11, 1979

[54] ARRANGEMENT FOR TURNING, MULTIPLE STACKING AND ALIGNING A PAPER STACK

[76] Inventor: Gerhard Busch, Heidenkampsweg 48, 2000 Hamburg 1, Fed. Rep. of Germany

[21] Appl. No.: 841,651

[22] Filed: Oct. 13, 1977

[30] Foreign Application Priority Data

May 18, 1977 [DE] Fed. Rep. of Germany ... 7715854[U]
May 25, 1977 [DE] Fed. Rep. of Germany ..... 2723496

[51] Int. Cl.[2] ..... B65H 31/40

[52] U.S. Cl. ..... 414/28; 34/23; 34/150; 271/221; 414/783; 414/903

[58] Field of Search ..... 214/1 BE, 1 Q, 1 QA, 214/1 S, 6 C, 6 S, 7, 152, 652, 653; 271/181, 195, 210, 221; 34/23, 145, 150; 93/36 SQ

[56] References Cited

U.S. PATENT DOCUMENTS

| | | | |
|---|---|---|---|
| 2,890,885 | 6/1959 | Harvey | 271/210 |
| 2,984,364 | 5/1961 | Lamb | 214/1 Q |
| 3,239,944 | 3/1966 | Gebert | 271/210 X |
| 3,259,992 | 7/1966 | Bonwit et al. | 34/150 X |
| 3,426,927 | 2/1969 | Woodward | 214/1 Q X |
| 3,563,360 | 2/1971 | Wickersheim | 271/221 X |
| 3,670,903 | 6/1972 | Hamilton | 214/1 Q |
| 3,895,722 | 7/1975 | Pluntz | 214/1 Q |
| 3,977,670 | 8/1976 | Tsuruta et al. | 34/150 X |

FOREIGN PATENT DOCUMENTS

| | | | |
|---|---|---|---|
| 1126416 | 3/1962 | Fed. Rep. of Germany | 214/1 Q |
| 2306899 | 11/1976 | France | 214/1 QA |

*Primary Examiner*—L. J. Paperner
*Attorney, Agent, or Firm*—Max Fogiel

[57] ABSTRACT

An arrangement for turning and multiple placing on top of each other and for alignment of paper stacks which are located on the rear contact plate of a turning stacker in a position preferably turned by 90°. Intermediate members in the form of a rake are placed between the individual paper stacks and are adjusted at the carrying column of carrying plate of the stacker. After introducing the paper stack and the intermediate member, the paper stack is preferably turned by about 90°. The entire surface of the rear contact plate of the turning stacker is thereupon vented by uniform air discharge. The paper stack is loosened and aligned by forming an air cushion under the stack and then turned to a final position. The carrying plates or carrying forks between which the stack to be turned is held, is provided each with one yoke, or connected by one yoke having rear spindle nuts fastened on a left- and right-hand spindle. The yokes of the carrying plates or carrying forks are guided with sleeves on column-like supports. The yokes mount limit switches for restricting the movement which actuate the device for initiating the turning process.

9 Claims, 7 Drawing Figures

ARRANGEMENT FOR TURNING, MULTIPLE STACKING AND ALIGNING A PAPER STACK

BACKGROUND OF THE INVENTION

The present invention relates to an arrangement for turning, multiple stacking and aligning a paper stack.

There has already been proposed an arrangement with which printed paper stacks are taken from a printing press with low-stack unloader, are turned and can be stacked in a high-stacker. This device, when using turning stackers comprises intermediate members in the form of a rake which have to be placed between the individual paper stacks and are to be adjusted at the carrying column or carrying plate of the stacker; the rake after being placed on the paper stack etc., is held in its position by a hydraulic or mechanical interlock. Through this holding of the rake on which, after turning, the first low stack rests, the maximum possible height is available for the running in of the second stack.

It is also known that the paper stacks to be turned, e.g., for imprinting the backside of the individual sheets of this stack, must be aligned before printing on the backside in order to obtain uniform printing on the individual sheets. Since the paper stacks involve relatively large dimensions with corresponding weights, the sheets had to be aligned, up to now, by hand in partial stacks which must be taken from the overall stack; this was cumbersome and tiring for operating personnel. In order to simplify things, it has been proposed that the paper stack be vented and thus loosened from the rear side of the turning stacker, i.e., in a position turned by 90°, by movable nozzles. Even this venting of the paper stack had only partial success since the air supplied by the nozzles always vented only part of the paper stack one at a time so that the alignment of the sheets also was only by sections. This method only spared the personnel the strenuous alignment by hand.

For economic processing of the individual sheets, it is required that the entire stack be aligned easily and quickly and the personnel be spared any strenuous effort.

It is therefore an object of the present invention to provide a method of aligning the entire stack to be turned in its position by 90°.

Another object of the invention is to provide arrangements which improve the holding of the paper stacks to be turned between the carrying plates and the carrying forks of the turning stacker and to make easier the alignment of the individual sheets of the entire stack.

A further object of the present invention is to provide also an arrangement making virtually impossible the tilting of the carrying plates or carrying forks.

A still further object of the present invention is to provide an arrangement, of the foregoing character, which may be carried out with relatively few steps, and which is economical to apply.

SUMMARY OF THE INVENTION

The objects of the present invention are achieved by providing that the paper stack is vented throughout the entire length of the rear contact area of the turning stacked by uniform air discharge, is loosened by forming an air cushion underneath the stack, and is then aligned.

Through the uniform air discharge, the entire stack floats on an air cushion and is loosened totally, so that the individual sheets of the stack can be aligned by a slight push without having to align section by section which was necessary up to now.

In order to implement this method, and to hold the paper stacks to be turned, carrying plates or forks are provided with a yoke or connected by a yoke; on their rear sides, sliding spindle nuts are fastened to a left- and right-hand spindle; a rotation of the spindle, e.g., by a worm drive, results in uniform motion of the carrying plates or forks. The yokes of the carrying plates or forks are equipped at their ends with sleeves which slide on column-like supports to guarantee perfect guidance.

To limit the motion of the carrying plates or forks, limit switches are placed on the yokes; these switches are connected to the device for releasing the turning process. This means, when the adjusted stroke of the carrying plates or forks has been achieved, the limit switch will initiate the turning process.

To align the individual paper sheets of the stacks, underneath the rear stop surface of the turning stacker, which surface has air discharge openings, there is a device which comprises an air channel in which a known device for re-directing the air for uniform air distribution underneath the exit openings is provided.

To avoid unnecessary air discharge with low paper stacks, the air channel is provided with two walls moving towards or away from each other which can be adjusted automatically from either side of the turning stacker by a contrarotating spindle or in accordance with the stack height.

In order to keep the dimensions of the air channel underneath the rear surface of the turning stacker low, the air discharge openings present in the rear surface may be connected at least in pairs.

With such a turning stacker, it is necessary to avoid any tilting of the carrying plates or forks. In accordance with the invention, the carrying plates or forks which can be moved towards or away from each other are supported via rollers running on guide rails and are protected against tilting about the transverse axis by limiting rollers.

This design prevents not only the undesirable tilting of carrying plates or forks; but also the entire construction moves easier because of the roller arrangement. The rollers running in the guide rails are located at the ends of roll sheets so that each carrying plate or fork slides on each side on two rollers which guarantees a safe support.

The limiting rollers preventing a tilting of the carrying plates or forks about the transverse axis are located above the guide rolls in the roll sheets. They slide along the outsides of the upper stringers of the guide rails and thus ensure a perfect position of the carrying plates or forks.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
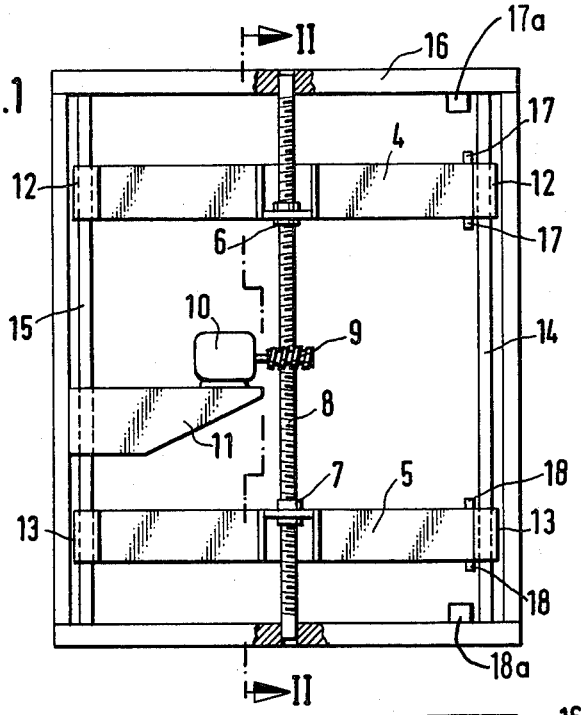
FIG. 1 is a schematic diagram and shows a rear view of the turning stacker.
Figure 2:
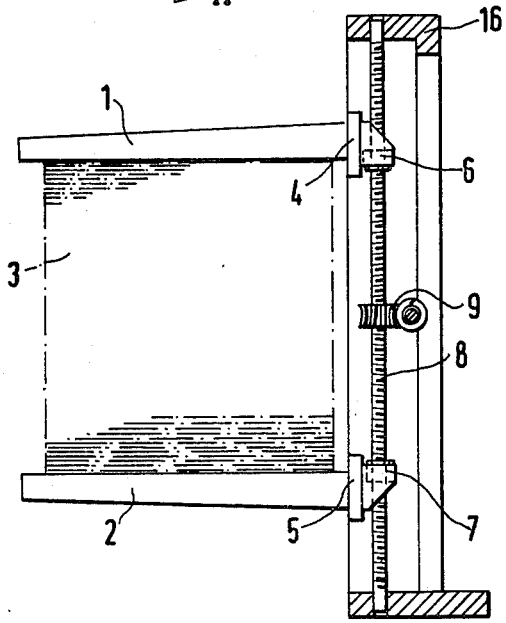
FIG. 2 shows a section taken along line II—II of FIG. 1.
Figure 3:
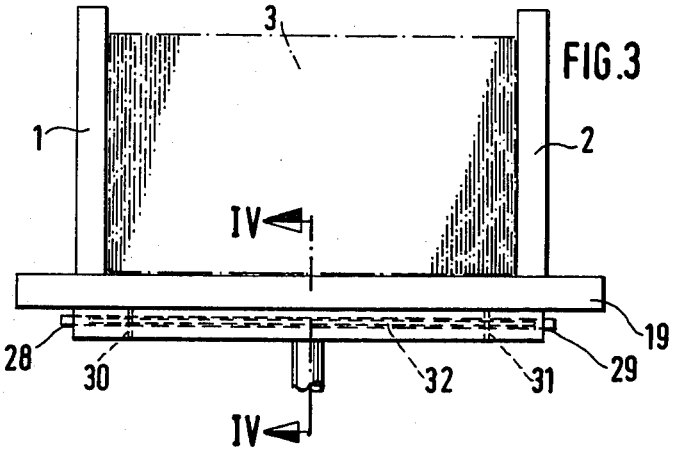
FIG. 3 shows the side view of a paper stack on the rear contact paper of the stacker which is turned by 90°.
Figure 4:
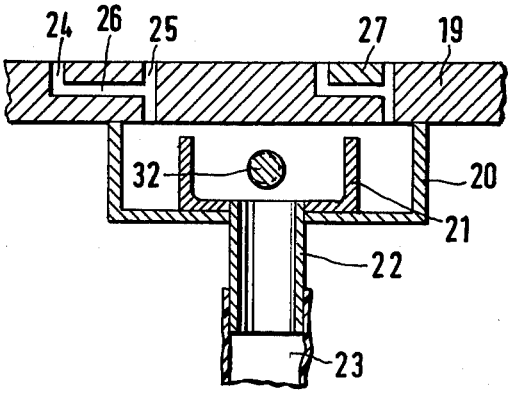
FIG. 4 shows a section taken along line IV—IV of FIG. 3.

Referring to the drawings, the turning stacker is equipped with carrying forks 1 and 2 between which the paper stack 3 to be turned is located. The carrying forks 1 are connected via a yoke 4 and the carrying yokes 2 are connected via a yoke 5. On the rearside of these yokes 4 and 5, are spindle nuts 6 and 7 which slide on a left- or right-hand spindle 8 and are moved towards each other or away from each other during rotation of spindle 8. The spindle 8 in the embodiment is driven via a worm drive 9 by a motor 10 which is located on a console 11 or similar structure.

The spindle 8 is held by its ends in the machine frame 16. At the ends, the yokes 4 and 5 are provided with sleeves 12 or 13 which slide on column-like supports 14 and 15 so that perfect parallel guidance of the yokes is ensured. To restrict the motion of yokes 4 and 5, limit switches 17 and 17 are provided; they work in conjunction with the stops 17*a*, 18*a*, and upon contacting these stops start the turning process.

The paper stack 3 lies between the carrying forks 1 and 2 at the rear contact plates of the turning stacker. Underneath the rear contact plate 19 is an air channel 20 in which a device 21, e.g., a U-shaped metal sheet, is provided for air deflection and uniform air distribution. This device 21 is connected to an air supply pipe 22 to which a hose 23 is connected.

Figure 5:
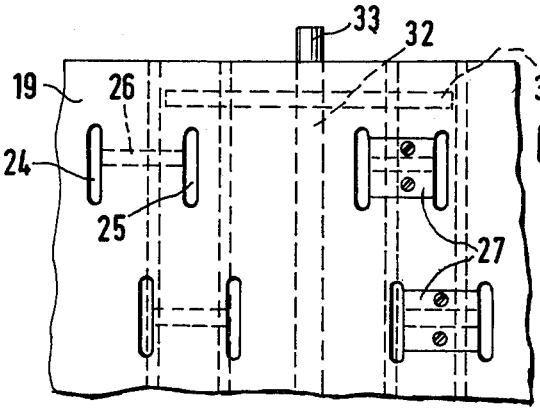
FIG. 5 shows a top view of the rear contact plate.
Figure 6:
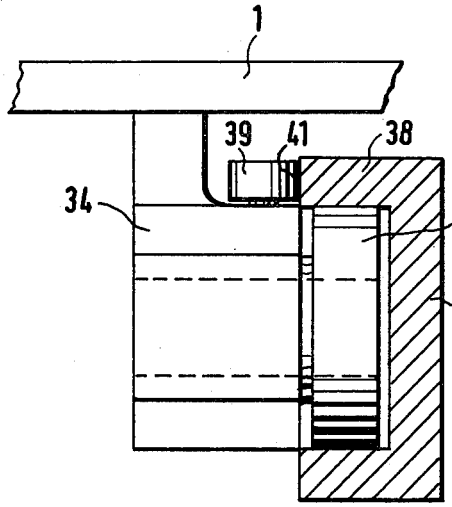
FIG. 6 shows the front view of a roll sheet with the rollers.
Figure 7:
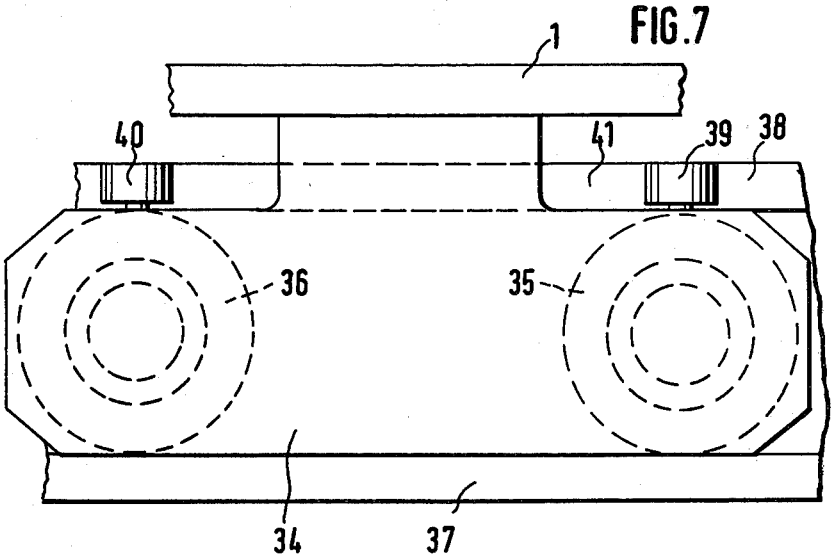
FIG. 7 shows the side view of the roll sheet.

The rear contact plate 19 has air discharge openings 24 and 25 which are connected via a channel 26 etc. The connecting channels 26 may be closed by suitable covers 27. The air discharge openings 24 and 25 are staggered, as shown in FIG. 5.

In air channel 20, walls 30, 31 are provided on both narrow sides 28, 29; these walls can be moved towards or away from each other and are adjusted by turning a counter-rotating spindle 32. On each end, the spindle 32 is provided with a trunnion 33 for attaching a crank or a hand grip.

When injecting air into the air channel 20, the air is deflected by device 21 and distributed so uniformly that it forms an air cushion when exiting from the openings 24 and 25 under the paper stack on which the latter virtually floats.

At the same time, the paper stack is loosened so that an aligning of the individual sheets can be accomplished by gentle patting.

Every carrying fork 1, 2 of the turning stacker is connected on each side with a roll sheet 34. This roll sheet 34 mounts a guide roller 35 or 36 on each end; they run in guide rails 37, which are part of columns 14 and 15, with close adherence to prevent a tilting movement around the longitudinal axis of the carrying forks 1, 2 or the roll sheet 34.

The machined outside 41 of the upper stringer 38 of guide rail 37, contact limit rollers 39 and 40 which are located above the guide rollers 35, 36 on the roll sheet 34 and prevent tilting of the carrying forks 1, 2 about the transverse axis.

The snug contact of guide rollers 35, 36 and of limit rollers 39, 40 in the guide rail 34 or on the outside 41 of the upper stringer 38, ensures safe guidance independent of all forces resulting from the weight of the paper stack 3 resting on the carrying forks 1, 2.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A device for turning and multiple placing on top of each other and for the alignment of paper stacks which are located on the rear contact plate of a turning stacker in a position preferably turned by 90°, comprising: fork-shaped members placed between individual paper stacks and being adjusted at a carrying plate of the stacker; means for venting the entire surface of the rear contact plate of the turning stacker by uniform air discharge after a paper stack has been turned substantially 90°; said paper stack being loosened and aligned by forming an air cushion under the stack and being thereafter turned to a final position; said fork-shaped members having carrying plates or carrying forks for holding the stack to be turned therebetween and have one yoke each; a left- and right-hand spindle; spindle nuts on said spindle and connected to said yoke; said rear contact plate having air discharge openings; an air channel underneath said rear contact plate and having means for air deflection and uniform air distribution underneath said air discharge openings; said air channel having narrow sides with walls displaceable relative to each other.

2. The device as defined in claim 1 including sleeves on column-shaped supports for guiding said yokes.

3. The device as defined in claim 1 including limit switch means on said yoke for restricting movement actuating said device for initiating the turning process.

4. The device as defined in claim 1 including a counter-rotating spindle connected to said walls displaceable relative to each other; trunnions on said counter-rotating spindle for attaching crank means.

5. The device as defined in claim 1 wherein said air discharge openings are connected at least in groups of two and are staggered.

6. The device as defined in claim 1 including roller means for supporting said carrying forks; guide rail means for guiding said rollers means; and limit roller means for preventing said carrying forks from tilting about a transverse axis.

7. The device as defined in claim 6 including roll sheets for mounting said roller means guided by said guide rail means.

8. The device as defined in claim 7 wherein said guide rail means has upper stringer means; said limit roller means being located in said roll sheets above said roll means guided by said guide rail means, said limit roller means contacting the outside of said upper stringer means.

9. The device as defined in claim 1 including sleeves on column-shaped supports for guiding said yokes; limit switch means on said yoke for restricting movement actuating said device for initiating the turning process; a counter-rotating spindle connected to said walls displaceable relative to each other; trunnions on said counter-rotating spindle for attaching crank means; said air discharge openings being connected at least in groups of two and being staggered; roller means for supporting said carrying forks; guide rail means for guiding said roller means; limit roller means for preventing said carrying forks from tilting about a transverse axis; roll sheets for mounting said roller means guided by said guide rail means; said guide rail means having upper stringer means; said limit roller means being located in said roll sheets above said roll means guided by said guide rail means, said limit roller means contacting the outside of said upper stringer means.

* * * * *